US007190272B2

(12) United States Patent
Yang et al.

(10) Patent No.: US 7,190,272 B2
(45) Date of Patent: Mar. 13, 2007

(54) EAS TAG WITH BALL CLUTCH

(76) Inventors: Xiao Hui Yang, 7926 McCellan Rd., Cupertino, CA (US) 95014; Arthur Bradley Fuss, 4235 Mary Ellen, #301, Studio City, CA (US) 91604

( * ) Notice: Subject to any disclaimer, the term of this patent is extended or adjusted under 35 U.S.C. 154(b) by 167 days.

(21) Appl. No.: 10/671,157

(22) Filed: Sep. 25, 2003

(65) Prior Publication Data

US 2004/0222890 A1 Nov. 11, 2004

Related U.S. Application Data

(60) Provisional application No. 60/468,459, filed on May 6, 2003.

(51) Int. Cl.
*G08B 13/14* (2006.01)

(52) U.S. Cl. ..... 340/572.8; 340/568.1; 340/572.1; 340/572.9; 340/571

(58) Field of Classification Search ..... 340/572.8, 340/572.9, 572.6, 572.4, 572.3, 572.1, 571, 340/568.1, 568.5, 568.7, 568.8
See application file for complete search history.

(56) References Cited

U.S. PATENT DOCUMENTS

| | | | | |
|---|---|---|---|---|
| 3,858,280 | A | 1/1975 | Martens | |
| 3,911,534 | A | 10/1975 | Martens | |
| 4,280,256 | A | 7/1981 | de Jong | |
| 4,311,992 | A | 1/1982 | DeChant | |
| 4,523,356 | A | 6/1985 | Charlot | |
| 4,660,025 | A | 4/1987 | Humphrey | |
| 5,031,756 | A | 7/1991 | Buzzard et al. | |
| 5,039,982 | A | 8/1991 | Bruhwiler | |
| 5,077,872 | A | 1/1992 | Guthammar | |
| 5,426,419 | A * | 6/1995 | Nguyen et al. | 340/572.9 |
| 5,528,914 | A | 6/1996 | Ngyun et al. | |
| 5,608,379 | A | 3/1997 | Narlow et al. | |
| 5,859,587 | A | 1/1999 | Alicot et al. | |
| 6,043,746 | A | 3/2000 | Sorrells | |
| 6,052,876 | A * | 4/2000 | Hogan et al. | 24/704.1 |
| 6,177,870 | B1 | 1/2001 | Lian et al. | |
| 6,215,400 | B1 | 4/2001 | Rand et al. | |
| 6,255,950 | B1 | 7/2001 | Nguyen | |
| 6,356,197 | B1 | 3/2002 | Patterson et al. | |
| 6,373,390 | B1 | 4/2002 | Hogan et al. | |
| 6,449,991 | B1 | 9/2002 | Hogan | |
| 6,474,117 | B2 * | 11/2002 | Okuno | 70/57.1 |

(Continued)

*Primary Examiner*—Daniel Wu
*Assistant Examiner*—Daniel Previl
(74) *Attorney, Agent, or Firm*—Waters Law Office; Robert R. Waters; Brian W. Foxworthy

(57) ABSTRACT

An electronic article surveillance tag is claimed wherein the tag features a spindle assembly which anchors and retains a set of ball bearings which are used to clutch and retain the shaft of a tack. The spindle features an operational tab which may be contacted by the appropriate probe to turn the spindle about a central axis. The spindle is seated in a retaining means with a graduated lip around the perimeter. The turning of the spindle serves to raise a portion of the spindle from the retaining means, loosening the ball bearing grip on the shaft of the tack. The electronic article surveillance tag may be used with either a smoothed or grooved tack shaft and may be operated by either mechanical probe actuation or by the use of a magnetic detachment means applied to the spindle.

22 Claims, 6 Drawing Sheets

U.S. PATENT DOCUMENTS

| | | | | |
|---|---|---|---|---|
| D466,426 | S | 12/2002 | Proulx et al. | |
| 6,631,629 | B1 * | 10/2003 | Fuss et al. | 70/57.1 |
| 6,896,133 | B2 * | 5/2005 | Spagna | 206/308.2 |
| 7,073,236 | B2 | 7/2006 | Xue et al. | |
| 2003/0222780 | A1 | 12/2003 | Sayegh et al. | |
| 2004/0172989 | A1 | 9/2004 | Seidel | |

* cited by examiner

EAS TAG WITH BALL CLUTCH

CROSS REFERENCE TO RELATED APPLICATIONS

This application claims priority from U.S. provisional application 60/468,459, filed on May 6, 2003. This application relates to an electronic article surveillance tag for use in protecting an item for shoplifting by producing an electronic signal upon entry into a pre-defined zone of interrogation. The entire disclosure contained in U.S. provisional application 60/468,459, including the attachments thereto, is incorporated herein by reference.

STATEMENT REGARDING FEDERALLY SPONSORED RESEARCH OR DEVELOPMENT

Not Applicable

BACKGROUND OF THE INVENTION

1. Field of the Invention

The present invention is directed to an Electronic Article Surveillance (EAS) Tag for use in shoplifting deterrence and inventory control in a retail establishment.

2. Description of the Related Art

EAS tags have been used for many years as a means of deterring retail shoplifting in clothing stores, electronic stores, and a myriad of other retail establishments. Generally speaking, an EAS system will consist of a durable and reliable, yet small, sensor tag which is affixed to the article to be detected in such a way that it cannot be easily removed by a customer in the store. Usually, the system depends on the feature that the attachment mechanism is constructed such that it can only be removed by the use of a specialized tool which is only in possession of the store personnel at the checkout register or exit port for the establishment. In the event that an EAS tag is not removed from a protected article prior to exiting the store, an alarm or other signal is activated.

In order for an EAS system to be reliable, the tag must be effective in that a shoplifter will be unable to remove it within the store. In some systems, the tag is encapsulated with an ink cartridge which will open and permanently destroy the protected item and make a considerable mess in the process. In other systems, the tag is anchored with an attachment mechanism that will cause destruction of the article if it is pulled or ripped from the article. In addition, the tag anchoring mechanism must be rigid enough to withstand efforts to crack it open within the store. In short, the EAS tag must be called upon to perform reliably amid challenges by the most clever and aggressive of shoplifters.

Although an assortment of attachment mechanisms are available in the prior art, one of the more common and more successful attachment mechanisms consists of a tack which is used to physically pin the protected article to the EAS tag base. The tag base is usually constructed of a hard and durable plastic and is generally in the neighborhood of three inches long. The tag serves as a housing for an electronic signal generation means secured within the housing, and which is designed to be immune to tampering. The security system is further characterized by one or more system receiver/transmitters which generates an interrogation zone in the general vicinity of the exit door to the retail establishment. The interrogation zone is usually defined by the installation of a pair of transmitters on each side of the exit doorway. When an EAS tag is moved into or through the surveillance zone, the electronic transmitter within the EAS tag will cause a signal to be generated which will be received by a system receiver to indicate that an unauthorized presence of a tagged article has been detected within the interrogation zone. Accordingly, alarms may sound or personnel may otherwise be alerted to the event such that the shoplifting can be thwarted at the exit port of the retail establishment.

Most of the tack-based EAS tags are constructed such that the tags which are removed at the checkout register may be re-attached to other merchandise for reuse. In general, the tack of the EAS tag may only be removed through the operation of a specialized detaching mechanism by store personnel. In some such systems, the detaching mechanism includes a probe which is inserted within the EAS tag to trigger a release latch located deep within the interior of the EAS tag and generally beyond the reach of foreign objects which could be used by a shoplifter, such as safety pins, pencils, wire probes, and the like. In other systems, magnetic detachers are used that have a magnetic strength from anywhere between 150 to 750 Gauss. These systems use a magnetic force to release the pin or tack from a clutching mechanism. Both magnetic and mechanical detachment systems are popular in retail establishments today.

In the patent art, electronic security tags have claimed a variety of specific forms and constructions over the years, and a wide assortment of attachment mechanisms have been claimed. An EAS tag featuring a tack which is releasably retained within the tag housing is generally well known in the art although the tack retention and release means have been the subject of numerous innovations. One such tag that has been commonly used in prior art systems is that claimed in U.S. Pat. No. 5,426,419 by Nguyen et al., entitled "Security Tag Having Arcuate Channel and Detacher Apparatus for Same". The Nguyen tag is comprised of a tack and a tag body. The tack shaft is inserted through a pin hole in the tag body and the tack is retained within the tag by a clutching mechanism. In order to release the clutching mechanism, a specific arcuate-shaped detachment tool must be inserted through an opening in the end of the tag. The opening within which the disengagement probe must be inserted features an arcuate channel which leads from the opening to the release trigger for the clutching means. The arcuate probe and channel provide a measure of security since it would be difficult for a shoplifter to insert a foreign object having the proper shape into the tag for release of the clutching means. A similar tag construction is found in U.S. Pat. No. 5,528,914 by Nguyen et al. wherein an EAS tag is releasably attached to the protected item with a spring clamp and a tack which is clamped to the tag body using a clutch-lock assembly. The detaching mechanism includes a probe adapted for insertion into the tag along with a drive means and timing means for controlling the energization of the drive such that it properly engages the release mechanism for the clutch-locked tack or spring clamp. Although novel in many respects, the Nguyen devices require yet another expensive detachment device which complicates the checkout area in the retail establishment. Multiple styles of detachment operation systems require too much space from the perspective of the retailer.

U.S. Pat. No. 6,215,400 B1 by Rand et al. discloses a security tag consisting of a security anchor with a central aperture. A security wire is threaded through the aperture in the anchor and is held securely. A PC board which includes a presence-detection diode is connected to one end of the security wire. Although perhaps effective as a shoplifting deterrent, the Rand mechanism is quite cumbersome and labor intensive to install and utilize.

U.S. Pat. No. 6,255,950 B1 by Nguyen discloses a tag assembly wherein the tack is modified to include a biasing structure such as a compression spring oriented within a tack assembly housing. The biasing structure serves to move the tack head and tack between an extended position and a retracted position. In the extended position, the tack extends from the aperture in the tack housing and can be pushed through the article and into the receiving aperture of the security tag. In the retracted position, the tack is positioned entirely within the tack housing such that the point of the tack is not exposed and therefore cannot cause injury to store personnel or others.

U.S. Pat. No. 6,373,390 B1 by Hogan et al. entitled "Electronic Article Surveillance Tag Having Arcuate Channel" features a tag body with an arcuate channel wherein an arcuate shaped detaching probe is used to release a tack from the security tag housing. The structure includes a spring clamp mechanism which provides the resistance to hold the shaft of the tack in place within the tag housing. The improvement disclosed by Hogan is the inclusion of an abutment means within the arcuate channel such as to prevent the insertion of a wire into the channel for contact with the releasing means. In general, the abutment means consists of a rigid planar abutment within the detachment channel.

U.S. Pat. No. 6,474,117 B2 by Okuno entitled "Anti-Theft Device" features a clamp member for clamping the pin of an attachment tack within a pinhole of the tag body. The tag body further houses an on/off switch which is to be depressed by a button on the attaching member and further features a theft alarm operable under the controls of on/off signals from the on/off switch. Such a system is unnecessarily complicated and is not as durable or universal as a purely passive mechanism for retaining a tack shaft within the tag housing.

In general, the prior art devices suffer from a number of drawbacks that limit the applicability of the device. In some cases, the tag article is too complicated to install or remove. In other cases, the tag article is too easy to defeat. Also, many articles require a specific detachment mechanism that is unique for that style of tag, requiring the retailer to purchase additional equipment for each checkout counter, and none of the prior art tag articles can be removed by either a magnetic detacher or a probe-style detacher. The present invention overcomes those obstacles.

SUMMARY OF THE INVENTION

The present invention is directed to an EAS security tag that avoids the limitations and problems that have compromised the utility of prior art devices. Specifically, the present invention is an EAS security tag which is relatively small and is constructed of hard plastic or metal. The tag construction is durable and provides structural integrity for housing an electronic sensor means which is designed to create a positive reading or output upon entry of the tag into a prescribed zone of interrogation. The structure of the mechanism for creating the interrogation zone and the electronic emittance means may include a number of pre-existing systems currently available in the marketplace. The EAS tag includes a tack consisting of a head and a shaft. The shaft of the tack is inserted into the article to be protected and after piercing through said article, is inserted into the EAS tag. The tack is retained by a three-ball clutch mechanism that enables the tack shaft to be reliably and securely retained unless and until the release means for the three-ball clutch mechanism is activated.

A primary objective of this invention is to provide an EAS security tag which is less cumbersome for the retailer to use. This EAS tag satisfies that objective as it may be detached by either the prevalent mechanical detacher as well as the magnetic detachers on the market today.

Another objective of the present invention is to provide an EAS security tag that is economical for the retail establishment in that the tag which is removed at the checkout counter may be re-used over and over without a deterioration in the quality of the tag's performance.

Another objective of the present invention is to provide an EAS security tag that is economical to construct for reduced mass production costs. A related objective is to create an EAS security tag that features a minimum number of discrete parts to both minimize production cost and minimize the fail rate of the article by reducing the number of moving parts within the structure of the tag.

Another objective of the present invention is to provide an EAS security tag wherein several pre-existing detachment means may be utilized to remove the tag at the checkout counter. This will alleviate the need to have multiple detachment means available at the checkout counter and make it easier for personnel to remove the tag such as to not slow down the checkout process.

Another objective of the present invention is to allow the retailer to use both a smooth and a grooved tack shaft to work with the EAS tag. Unlike many prior art systems, the present tag can use both types of tack pins and may be detached by either a mechanical or magnetic force detacher.

As discussed above, the method and device of the present invention overcomes the disadvantages inherent in prior art methods and devices. In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also it is to be understood that the phraseology and terminology employed herein are for the purposes of description and should not be regarded as limiting.

Accordingly, those skilled in the art will appreciate that the conception upon which this invention is based may readily be utilized as the basis for other structures, methods and systems for carrying out the purposes of the present invention. It is important, therefore, that the specification be regarded as including such equivalent constructions insofar as they do not depart from the spirit of the present invention.

Furthermore, the purpose of the foregoing Abstract is to enable the U.S. Patent and Trademark Office and the public generally, and especially including the practitioners in the art who are not familiar with patent or legal terms or phraseology, to determine quickly from a cursory inspection, the nature and essence of the technical disclosure of the application. The Abstract is neither intended to define the invention of the application nor is it intended to be limiting to the scope of the invention in any way.

BRIEF DESCRIPTION OF THE DRAWINGS

Additional utility and features of this invention will become more fully apparent to those skilled in the art by reference to the following drawings, wherein all components are designated by like numerals and described more specifically.

DETAILED DESCRIPTION OF THE PREFERRED EMBODIMENT

Figure 1:
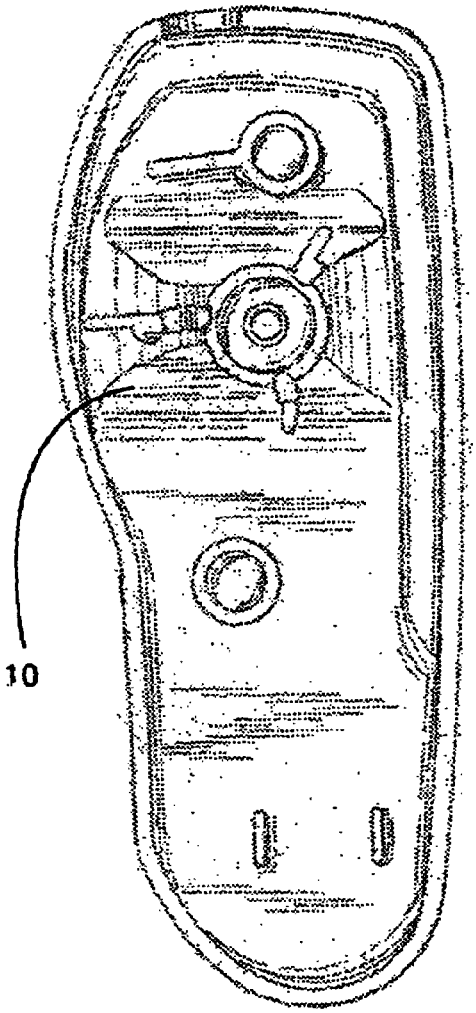
FIG. 1 is a plan view of the top half of the tag housing, showing the interior structure of the top half of the tag housing.
Figure 2:
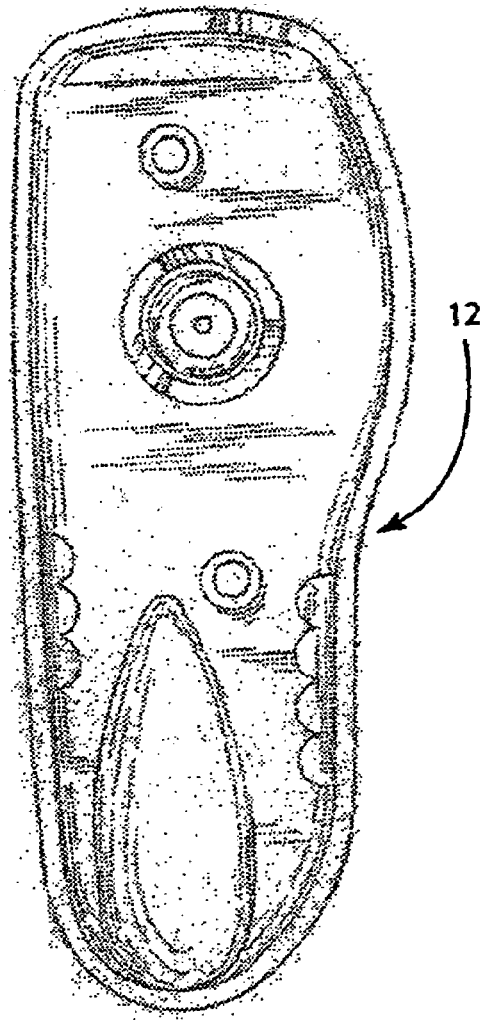
FIG. 2 is a plan view of the bottom half of the tag housing, showing the interior structure of the bottom half of the tag housing.

The preferred embodiment of the present invention, herein described, is a generally plastic article although other materials may also be used. The EAS tag is approximately three inches in overall length, and the tag housing consists of two molded plastic halves, a top and bottom housing structure shown as 10 in FIGS. 1 and 12 in FIG. 2, respectively. Upon assembly of top half 10 and bottom half 12, a shell is formed that houses both the fastening and release mechanisms and an electronic sensing mechanism 20 (shown in FIG. 5). Upon assembly of the tag to include the essential fastening and sensing elements, the tag is placed adjacent to the protected article and an anchoring tack 24 is inserted through both. An opening 26 in the security tag receives the anchoring tack and locks it in place such that the tack 24, and hence the security tag, cannot be removed unless a special tool is utilized to engage the release mechanism inside the security tag.

The electronic sensing element 20 inside the security tag is designed such that passage of the security tag through a detection field or detection zone results in an audible or visible alarm, or other triggering mechanism.

In general, the retail establishment will feature one or more permanently mounted detection mechanisms oriented above or about the exit door of the establishment. The detection equipment generates a security field or magnetic field in the vicinity of the exit and the field is tuned such as to detect the electronic element inside the shoplifting deterrent tag if the tag were to pass through the field. The preferred embodiment described herein features a 58 KHz field and the electronic element within the shoplifting deterrent tag is appropriately constructed and oriented to be detected by the detection mechanism, and an alarm is activated. However, the specific field generation and alarming means may vary, and the tag claimed herein is not limited to any specific field generation and alarm mechanism.

Figure 3:
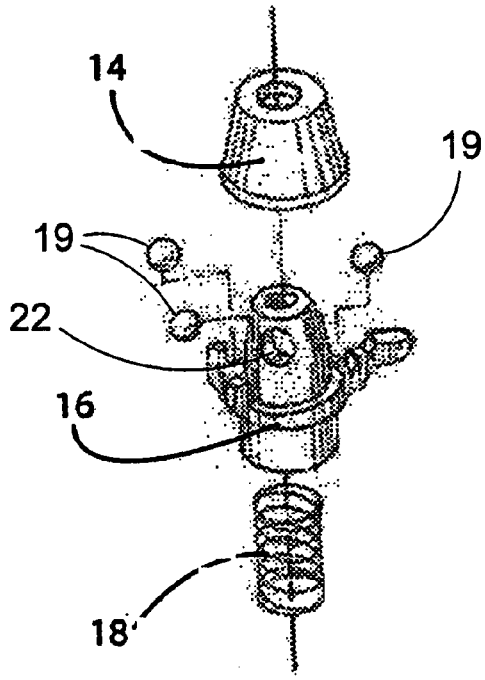
FIG. 3 is an exploded perspective view of the operable elements of the tag, and specifically the spring, spindle, ball bearings and cup housing.
Figure 4:
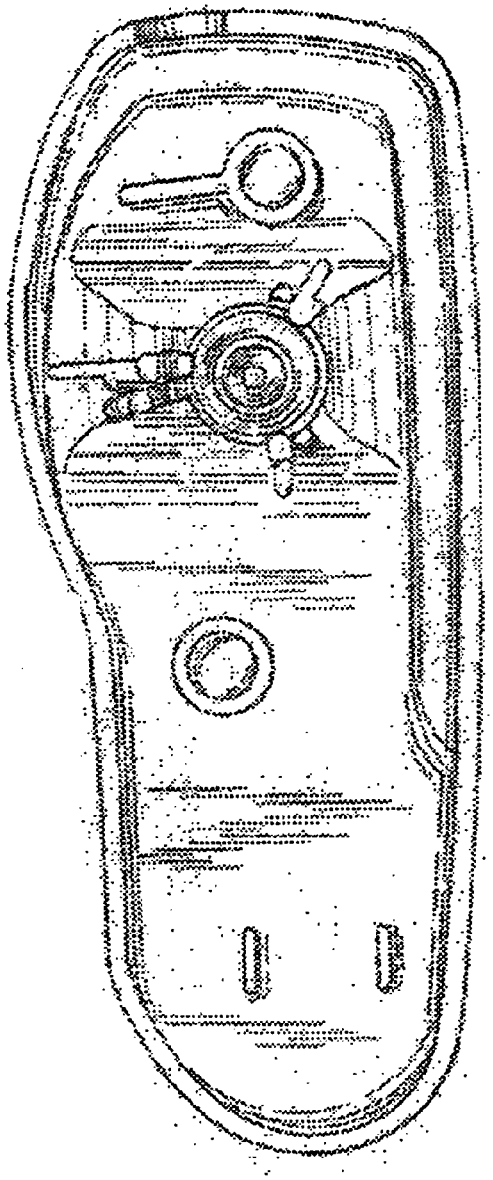
FIG. 4 is a plan view of the top half of the tag housing, showing the spindle assembly inserted into the tag housing.
Figure 5:
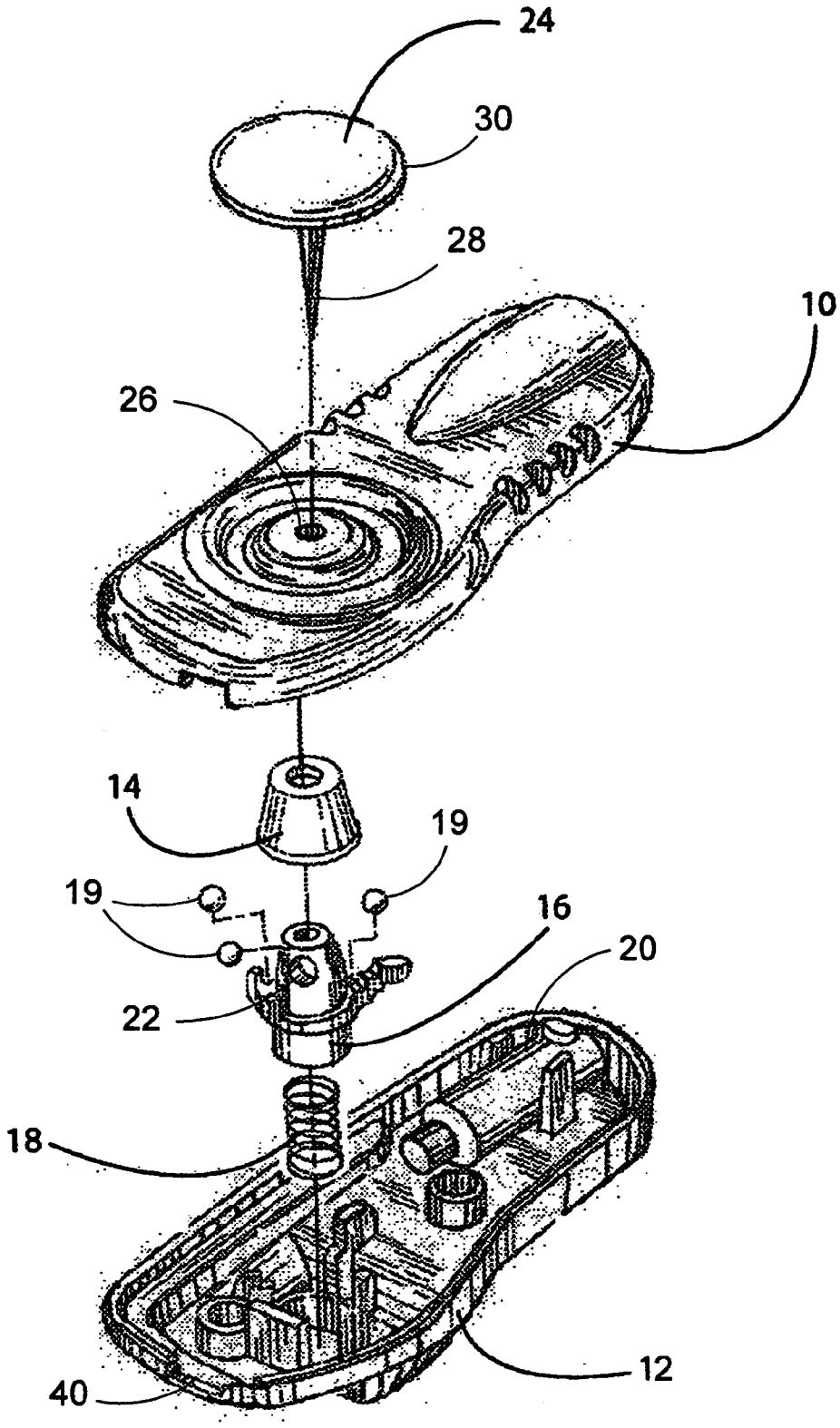
FIG. 5 is an exploded perspective view of the tag assembly showing the assembly progression of the primary components.

Significant performance and ease of use improvements over prior art tack-based tag systems have been achieved with the present invention due to the novel use of a three-ball clutch mechanism to engage and secure the fastening tack 24 within and against the EAS tag housing. The components of the three-ball clutch mechanism are shown in FIG. 3. Specifically, the security tag interior housing is designed such as to include a "bowl like" recessed area within the top half housing 10 about the insertion hole 26 for the anchoring tack 24. (See FIG. 5.) The recessed area supports a small cup 14, within which a three prong spindle 16 is seated. As shown in FIGS. 3 and 5, the seat of the spindle is located within cup 14 while the three prongs of spindle 16 surround the outer perimeter of cup 14.

The three pronged spindle element 16 is the primary operational member with respect to release of the anchoring tack 24. The spindle 16 consists of a central region designed to seat comfortably inside the aforementioned cup 14. The center of the spindle seat is hollow with three openings 22 in the perimeter of the seat. Three ball bearings 19 are disposed within the seat of the spindle and the spindle seat features a hollow interior region dimensioned such that three ball bearings fit snugly within the spindle seat which in turn is seated within the cup 14. Upon insertion of the shaft 28 of the tack 24 through tag housing 12, the tack shaft 28 enters the center of the spindle such as to separate the three ball bearings which were already disposed in a snug arrangement within the spindle seat. The added force of the tack shaft 28 separates the ball bearings such as to force them apart and through the holes in the spindle seat, against the limited area between the spindle 16 and the interior wall of cup 14. As a result, the shaft 28 of the tack 24 is clutched by ball bearings 19 and will not be released upon tugging on the head 30 of the tack 24.

Figure 6B:
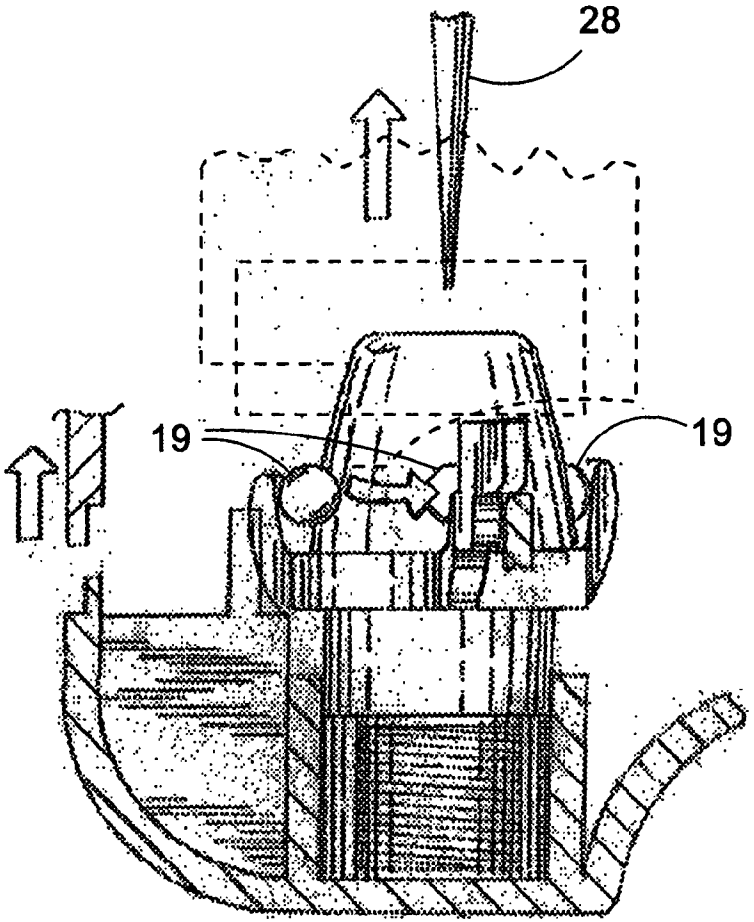
FIGS. 6*a* and 6*b* are progression drawings of the operation of the spindle showing the camming action of the spindle with respect to the seat of the tag housing.
Figure 6A:
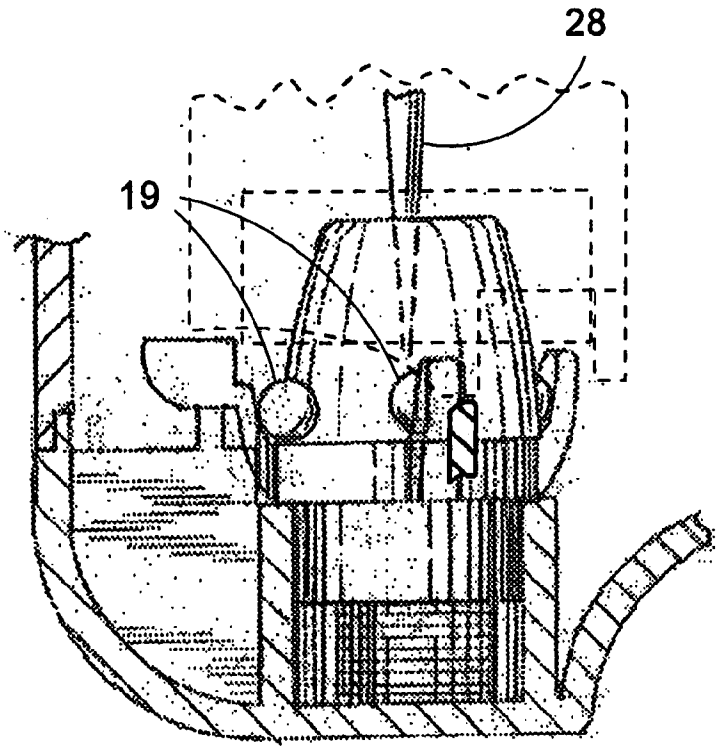
Figure 8:
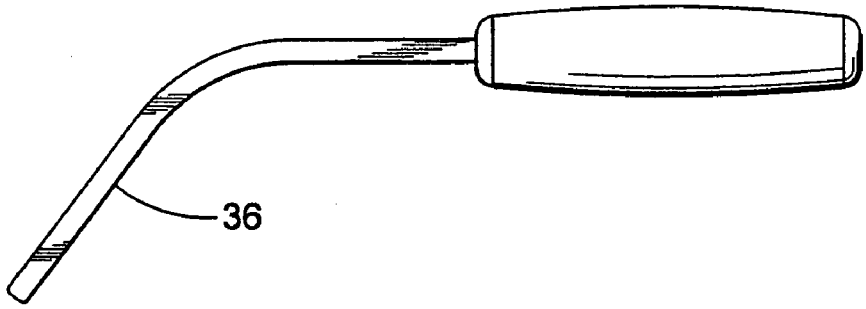
FIGS. 8–10 show embodiments of the probe which may be inserted into the tag.
Figure 9:
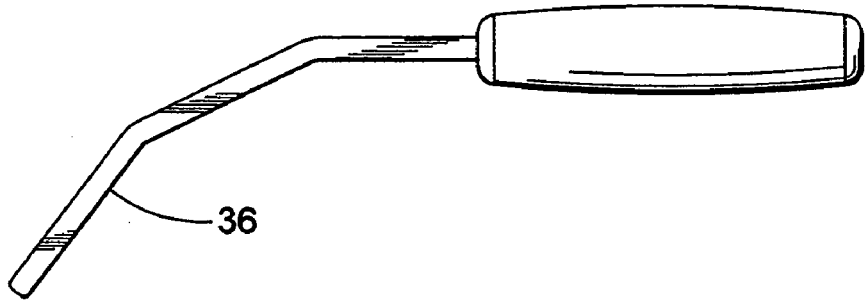
Figure 10:
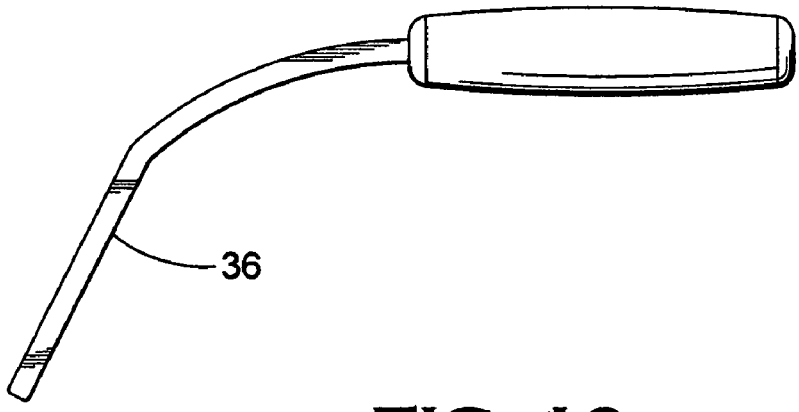

The spindle 16 is further characterized by three prongs oriented on the outer perimeter of the spindle which serve to support the spindle while also serving to couple with a molded plastic complimentary seat 32 within the plastic tag body. One of the spindle support legs 38 is larger than the other two and serves the purpose of providing a point of contact for an operational release probe 36, of which various embodiments are shown in FIGS. 8, 9, or 10. These probes 36 represent only a few embodiments of possible probes that may fit. When such a probe 36 is inserted into the body of the retail tag at opening 40, the spindle support leg 38 is struck and the spindle 16 is caused to rotate accordingly. A plastic ridge along the edge of the support seat 32 is constructed such that as the spindle is turned by striking the support leg 38 with a probe 36, the spindle seat is lifted slightly from the cup structure 14. After the spindle 16 is turned approximately one quarter turn, the spindle 16 is sufficiently removed from the cup 14 such that the ball bearings are moved into a larger diameter region of cup 14, allowing the ball bearings to separate and release from contact with the shaft 28 of the fastening tack 24 and the cup wall. At that point, the fastening tack 24 may be easily removed from the EAS tag housing 12. FIGS. 6*a* and 6*b* are a pair of progression drawings showing the operation of the camming action as the spindle turns.

In order to facilitate a more effective clutching of the tack shaft 28 by the ball bearings, the tack shaft 28 may feature notches or flat areas in an otherwise round shaft circumference in order to provide a surface more easily anchored in the vicinity of the ball bearings.

Figure 7:
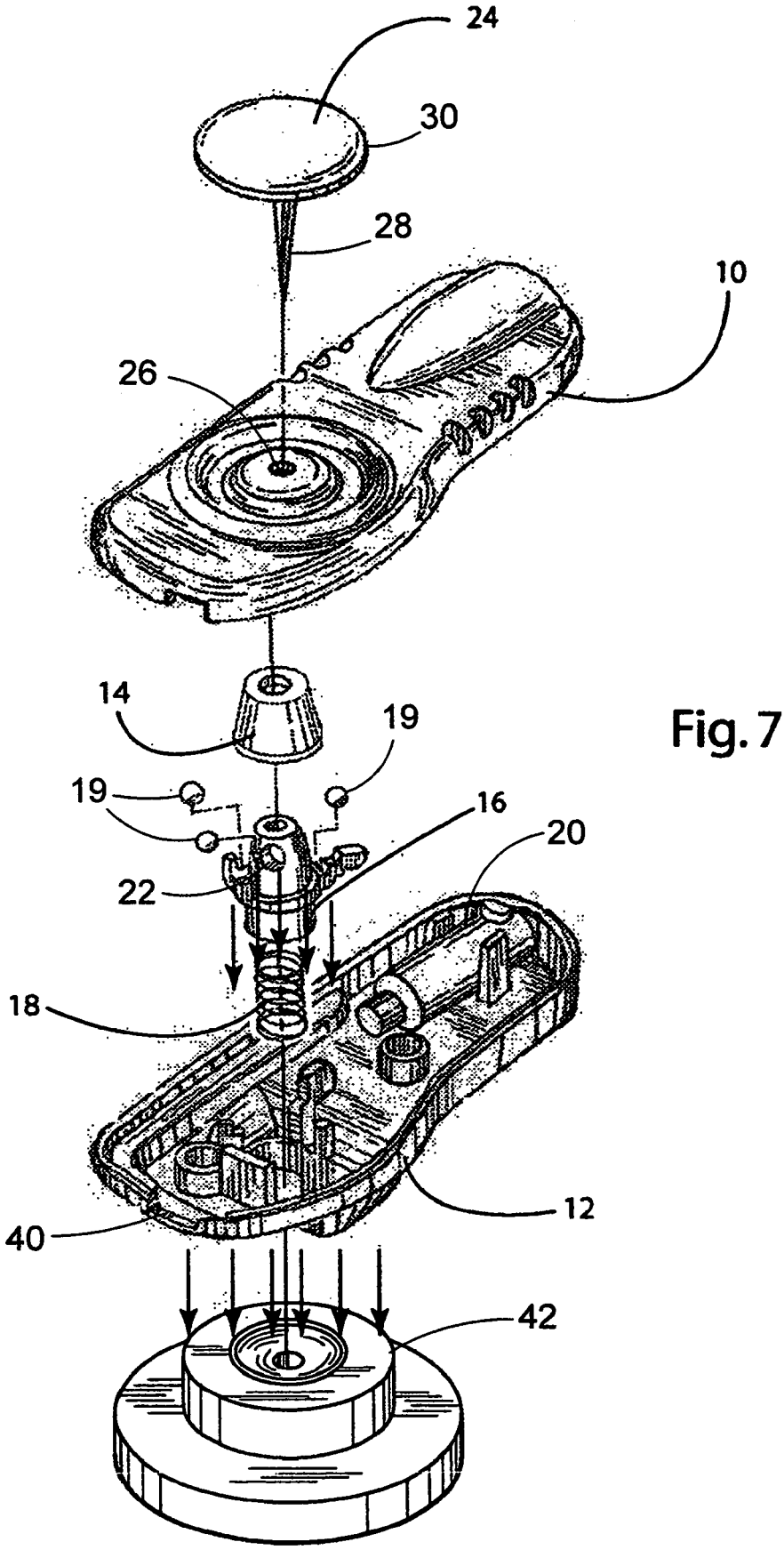
FIG. 7 is an exploded perspective view of the tag assembly showing the operation of the tag with a magnetic detachment means.

The EAS tag disclosed herein is a very versatile article as it may alternatively be operated through the use of a magnetic detachment mechanism. In order to facilitate such an operation, the seat portion of the spindle must be constructed of a ferrous material or some other material that is highly attracted by a magnet. In use, the store clerk will place the EAS tag adjacent a magnetic detacher with the side opposite the tack (side 12) facing or placed against the detacher. The detacher exerts a magnetic force which will act upon the spindle seat and draw it closer to the magnet. This force will cause the spring 18 to compress as the magnetic force overcomes the biasing force of spring 18. Upon compression of the spring 18, the spindle 16 will be raised from cup 14 such that ball bearings 19 are allowed into the larger diameter portion of cup 14. Accordingly, the ball bearings 19 separate and release tack 24 for removal from the tag housing 10. FIG. 7 shows the use of the electronic article surveillance tag with a magnetic detacher 42.

We claim:

1. An electronic article surveillance tag comprising: a) a tag housing; b) a tack consisting of a tack head and a tack shaft wherein said tack shaft is inserted through a portion of the article to be protected and into a first opening in said tag housing; c) a releasable ball bearing clutching means within said tag housing for retaining a portion of said tack shaft within said tag body, said releaseable ball bearing clutching means utilizing at least three ball bearings acting upon said tack shaft; d) a second opening in said tag housing for insertion of a probe which operates to release said ball bearing clutching means; and e) a sensor means contained within said housing.

2. The tag of claim 1 wherein said ball bearing clutching means comprises a set of three ball bearings retained within a spindle which generally retains the balls in a spaced relationship to each other, said spindle further incorporating a central aperture which is oriented directly beneath said first opening in said tag housing such that said tack shaft is inserted through the central aperture of said spindle.

3. The tag of claim 2 wherein said spindle is further characterized as featuring; a) a hollow annular portion within which said three ball bearings are disposed and wherein said hollow portion further features three openings along the outer wall of said annular portion sized such that a portion of said ball bearings may protrude through said openings if said tack shaft is inserted into said central aperture of said spindle and forces said ball bearings outward; and b) three or more support legs which support said spindle while orienting said hollow annular portion axially with respect to said first opening in said housing.

4. The tag of claim 3 wherein said hollow annular seat portion of said spindle is made of a material which is attractive to a magnet.

5. The tag of claim 3 wherein one of said support legs features an engagement tab designed to be contacted by a probe inserted into said second opening in said tag housing such that contact of said engagement tab by said probe serves to rotate said spindle about a central axis.

6. The tag of claim 3 wherein said clutching means is further comprised of a cup within which said spindle and bail bearings are placed and wherein said cup is tapered gradually from the top edge of the cup to the bottom of the cup.

7. The tag of claim 6 wherein said tapered cup, spindle and ball bearings are sized such that when said tack shaft is fully inserted into said tag housing and through the central aperture of said spindle, the tack shaft will be tightly wedged between the three ball bearings which are tightly held by the wall of said tapered cup such that said shaft is prevented from being removed from said tag housing.

8. The tag of claim 6 wherein said tag housing is further characterized in that said housing features a seat portion integral to said housing, and wherein said tapered cup is disposed in said seat portion.

9. The tag of claim 8 wherein said seat portion features a graduated lip portion around the circumference of said seat and wherein said engagement tab of said spindle may be caused to ride along the edge of said lip portion upon engagement of said tab by a probe inserted into said housing through said second opening, thereby turning said spindle and wherein said spindle is caused to raise from said tapered cup by the operation of said engagement tab traveling upon said lip portion as said tab is turned, and wherein the lifting of said spindle from said tapered cup enables said ball bearings to separate as a portion of each said ball bearing is allowed to protrude from the annular wall of said central spindle portion, and which accordingly enables said tack shaft to be released from the grip of said ball bearings for removal of said tack from said tag housing.

10. The tag of claim 9 wherein said tack shaft is released from said clutching means after said spindle has been rotated approximately one quarter turn.

11. The tag of claim 6 wherein a biasing means is disposed within said housing which urges said spindle into said cup.

12. The tag of claim 11 wherein said biasing means is a spring.

13. The tag of claim 6 wherein said cup is constructed of a metal.

14. The tag of claim 1 wherein said tag housing is constructed of two pieces of hard plastic.

15. The tag of claim 1 wherein said tack shaft features regions of varied diameter in order to assist said clutching means in maintaining a tight grip on said shaft during retention of said shaft in said housing.

16. The tag of claim 15 wherein said shaft features one or more regions wherein said shaft is flattened.

17. An electronic article surveillance tag comprising: a) a tag housing; b) a tack consisting of a tack head and a tack shaft wherein said tack shaft is inserted through a portion of the article to be protected and into a first opening in said tag housing; c) a releasable ball bearing clutching means within said tag housing for retaining a portion of said tack shaft within said tag body, said releaseable ball bearing clutching means utilizing at least three ball bearings acting upon said tack shaft; d) a biasing means for effecting the operation of said releasable ball bearing clutching means; and e) a sensor means contained within said housing.

18. The tag of claim 17 wherein said biasing means is a spring.

19. The tag of claim 18 wherein a magnetic detacher may be used to compress said spring to operate said ball bearing clutching means, thereby releasing said tack shaft far removal from said tag.

20. An electronic article surveillance tag comprising: a) a tag housing; b) a tack consisting of a tack head and a tack shaft wherein said tack shaft is inserted through a portion of the article to be protected and into a first opening in said tag housing; c) a releasable ball bearing clutching means within said tag housing for retaining a portion of said tack shaft within said tag body, said releaseable ball bearing clutching means utilizing at least three ball bearings acting upon said tack shaft; d) a second opening in said tag housing for insertion of a probe which operates to release said ball bearing clutching means; e) a biasing means for effecting the operation of said releasable ball bearing clutching means; and f) a sensor means contained within said housing.

21. An electronic article surveillance tag of claim 20 wherein the release of said tack shaft from said tag may be accomplished by compressing said biasing means by either a magnetic detacher or by insertion of a probe into said second opening in said housing.

22. An electronic article surveillance system comprising: a) a tag housing; b) a tack consisting of a tack head and a tack shaft that is inserted through a portion of the article to be protected and into a first opening in said tag housing; c) a releasable ball bearing clutching means for retaining said tack shaft, said means comprising a set of three ball bearings retained within a spindle which generally retains the balls in a spaced relationship to each other, said spindle further incorporating a central aperture which is oriented directly beneath said opening in said tag housing such that said tack shaft is inserted through the central aperture of said spindle; d) a second opening in said tag housing for insertion of a probe which operates to release said ball bearing clutching means; e) a sensor means contained within said housing which functions to transmit a signal upon the entry of the protected article into a pre-defined surveillance zone; and f) a means for receiving said signal to detect the presence of the protected article in the surveillance zone.

* * * * *